United States Patent [19]

Moore et al.

[11] Patent Number: 4,577,567

[45] Date of Patent: Mar. 25, 1986

[54] METHOD OF COMBUSTION AND BURNERS

[75] Inventors: Colin Moore, Bradford, England; David P. Jenkins, Neath, Wales

[73] Assignee: The BOC Group, plc, London, England

[21] Appl. No.: 619,865

[22] Filed: Jun. 12, 1984

[30] Foreign Application Priority Data

Oct. 5, 1983 [GB] United Kingdom ..... 8326685

[51] Int. Cl.[4] ..... F23D 1/00

[52] U.S. Cl. ..... 110/347; 110/263

[58] Field of Search ..... 110/347, 263, 264, 265

[56] References Cited

U.S. PATENT DOCUMENTS

| | | | |
|---|---|---|---|
| 3,124,086 | 3/1964 | Sage et al. | 110/347 |
| 4,211,174 | 7/1980 | Martin et al. | 110/347 X |
| 4,380,960 | 4/1983 | Dickenson | 110/347 |

*Primary Examiner*—Edward G. Favors

*Attorney, Agent, or Firm*—David A. Draegert; Larry R. Cassett

[57] ABSTRACT

A composition comprising a particulate fuel, typically pulverized coal, carried in water is formed such that it is readily able to be pumped without adding emulsifiers or lubricants to the composition. The composition typically includes at least 25% water and preferably 30 to 50% water. The composition is pumped to a burner 2 and is atomized therein, typically by means of a stream of oxygen supplied through a passage 6 in the nozzle 6 of the burner. This oxygen is taken from that supplied to a further passage for supporting combustion of the particulate fuel. A relatively short and intense flame can be produced at relatively low coal concentrations in the composition such that the need to use expensive emulsifiers etc. is avoided.

12 Claims, 4 Drawing Figures

METHOD OF COMBUSTION AND BURNERS

DESCRIPTION OF THE INVENTION

This invention relates to a method of combustion and to fuel burners. It is particularly concerned with the combustion of a particulate fuel, particularly pulverised coal, in an aqueous carrier medium.

It is known to burn pulverised coal in an aqueous carrier medium using air to support combustion of the coal. Even if large volumes of excess air are used it is found necessary to employ around 75% by weight of coal in the combined pulverised coal-aqueous carrier mixture in order to obtain adequate combustion of the coal unless the air is preheated to a substantial extent. At such high concentrations of coal, difficulties arise in transporting the coal-aqueous carrier mixture to the burner and one or both of special high pressure pumping equipment or special grinding equipment is typically required. Alternatively, in order to facilitate transport of the coal in suspension in an aqueous carrier various additives such as emulsifiers and stabilisers may be incorporated in the aqueous carrier medium. Whichever of these expedients is resorted to, considerable additional costs are entailed. For example, it if is decided to preheat the air, a large heat exchanger is typically required to heat exchange the gaseous products of combustion with the air.

We have performed experiments using commercially pure oxygen rather than air to support combustion of pulverised coal in suspension in water. We have obtained two surprising results.

First, we have managed to burn a composition comprising pulverised coal of normal commercially available particle size in suspension in water, said composition including only 60% by weight of coal. We have therefore found it unnecessary to add emulsifiers to the composition to facilitate pumping of the composition or to use special high pressure pumping equipment.

Second, by atomising the water we have been able to obtain a flame that resembles a typical fuel oil-oxygen flame, i.e. one that is relatively short and hence has a relatively intense flame.

Both these results may be achieved without preheating the oxygen or oxygen-enriched air.

According to a first aspect of the present invention, there is provided a method of burning a particulate fuel, which comprises supplying to a combustion zone and atomising a composition which comprises 50 to 70% by weight of particulate fuel and 30 to 50% by weight of an aqueous carrier and which is able to be pumped without the presence in the composition of an emulsifying agent or lubricant to facilitate such pumping, and also supplying to the combustion zone substantially pure oxygen or oxygen-enriched air whereby to support combustion of the particulate fuel.

We prefer to atomise the composition, at least until a chosen temperature has been attained in an enclosure being heated by burning the particulate fuel and preferably continuously, whereby to obtain a flame having a temperature profile similar to an oxygen-oil flame. The atomisation is preferably carried out upstream of the combustion zone.

The particulate fuel is preferably pulverised coal. In this connection the term coal includes within its scope mineral coal, anthracite coal, sub-bituminous coal and lignite.

We prefer not to preheat the oxygen or oxygen-enriched air to any substantial extent, i.e. we find it unneccesary to employ a heat exchanger to raise the temperature of the oxygen or oxygen-enriched air by heat exchange with the gaseous combustion products. Typically, the oxygen or oxygen-enriched air is supplied to the combustion zone at ambient temperature; and so is the said composition.

The proportion of coal in the composition is selected such that the composition is readily able to be pumped without the presence of an emulsifying or other chemical agent or lubricant to facilitate such pumping. Generally a composition including from 55 to 65% by weight of coal and particularly one containing about 60% by weight of coal and a balance of water will meet this criterion.

The coal is typically present in the composition in a range of particle sizes. One suitable bituminous coal composition had 73.6% by weight of its particles passing through a sieve of 106 microns in mesh size; 57.8% passing through a sieve of 75 microns (200 mesh) in mesh size and 40.7% passing through a sieve of 40 microns in mesh size. Spiers Technical Data on Fuel, Sixth Edition, 1961, published by the The British National Committe, World Power Conference, 201 Grand Building, Trafalgar Square, London, WC2, 1961 quotes (at Page 300) a proportion of 70% of bituminous coal particles passing through a sieve of 75 microns mesh size (200 mesh) as being typical of a pulverised bituminous coal composition, i.e. the typical composition is considerably finer than the one which is described above as being suitable for use in accordance with the invention and which contains less than 60% by weight of particles passing through a 75 micron mesh size. This is a relatively coarsely ground composition. Such a range of particle sizes as described above can be produced in simple wet grinding equipment of conventional design that can be employed on site with a burner or burners used to perform the method according to the invention.

The composition is preferably atomised by introducing an atomising agent into it. The atomising agent is preferably a pressurised non-condensible fluid. Compressed air may for example be used as the atomising agent and may be introduced into the said composition upstream of a burner employed to burn the composition. Alternatively, substantially pure oxygen or oxygen-enriched air may be used as the atomising agent, a part of the oxygen or oxygen-enriched air supplied to the combustion zone being used for this purpose.

A burner for use in the present invention may be of relatively simple construction. The burner typically has an outer shell (which may have a cooling jacket) and a head or nozzle located within the shell at or near its outlet end. The head or nozzle preferably defines an inner passage or passages for the said composition and may define separate passage(s) for oxygen or oxygen-enriched air, or alternatively may define with the shell one or more passages for this purpose. The tip of the head or nozzle may be coplanar with the tip of the shell or may be set inside the shell.

If desired the burner may be provided with a passage for an auxiliary fluid fuel which may be burnt at start-up of the burner in order to facilitate the creation of a stable flame. Propane may be employed as the said auxiliary fuel. The passage for the auxiliary fuel may be formed through the head or nozzle of the burner.

In a preferred burner the head or nozzle has a passage communicating at one end with the passage for oxygen or oxygen-enriched air (or with one such passage if more than one oxygen or oxygen-enriched air passage is provided) and at its other end with the passage for the sald composition, whereby a proportion of the oxygen or oxygen-enriched air is able to be diverted into the passage for the said composition so as to atomise its water. Typically, from 5%–10% by volume of the oxygen or oxygen-enriched air is so diverted.

The present invention also provides a particulate fuel burner for burning a composition comprising water and particulate fuel, said burner including a head or nozzle, at least one passage through the head or nozzle for said composition, at least one passage for substantially pure oxygen or oxygen-enriched air, and an auxiliary passage affording communication between a (or the) oxygen passage and a (or the) composition passage whereby in operation of the burner oxygen or oxygen-enriched air is able to be conducted into the said composition passage so as to atomise the said composition.

The methods and burner according to the invention will now be described by way of example with reference to the accompanying drawings, in which.

Figure 1:
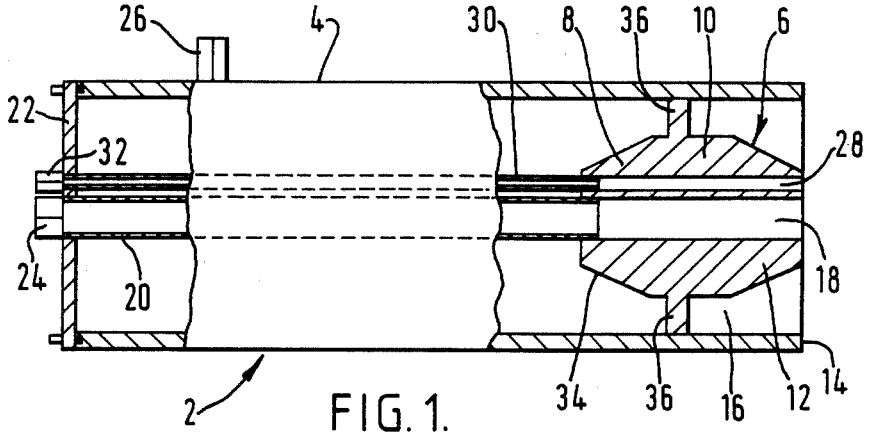
FIG. 1 is a schematic side elevation, partly in section, of a burner according to the invention for burning a composition comprising pulverised coal and water.

The drawings are not to scale.

Referring to the accompanying drawings, a burner 2 has an outer shell 4 and an inner head or nozzle 6. The head or nozzle 6 is coaxial with the shell 4 and is in the form of a monolithic body having a frusto-conical innermost portion 8 diverging in the direction of the burner tip 14, a central right cylindrical portion 10, and an outermost frusto-conical portion 12 converging in the direction of the burner tip 14.

The head of nozzle 6 and the shell 4 define therebetween a generally annular passage 16 for substantially pure oxygen or oxygen-enriched air. The head or nozzle 6 has a central relatively unrestricted axial passage 18 therethrough for a composition of water and pulverised coal. A conduit 20 is received in the passage 18 and extends between the head or nozzle 6 and a backplate 22 of the burner 2. The backplate 22 is provided with connecting means 24 whereby a supply of coal-water slurry or composition can be pumped by means not shown to the conduit 20 and thence the passage 18 of the head or nozzle 6. The shell 4 is similarly provided with connecting means 26 whereby oxygen or oxygen-enriched air may be passed from outside the burner into the interior of the shell 4 and thence to the passage 16.

The head of nozzle 6 has a relatively narrow passage 28 therethrough extending parallel to the central passage 18 and receiving a conduit 30 for the supply of propane or other combustible fluid. The conduit 30 is received in the backplate 22 which is provided with a connecting means 32 whereby the conduit 30 can be connected to a source of propane (not shown).

The head or nozzle 6 also has an auxiliary passage 34 extending and affording communication between the passage 16 and the passage 18 thereby enabling oxygen to flow from the passage 16 into the passage 18 so as to atomise the water supplied to the passage 18 with the pulverised coal.

The head or nozzle 6 is typically formed of copper and is in good heat-conductive relationship with the shell 4. The head or nozzle 6 has integral therewith three equally spaced lugs 36 about the circumference of its right cylindrical portion 10 which engage the inner surface of the shell 4. The shell 4 is typically provided with a jacket (not shown) through which a coolant such as air or water may be circulated so as to prevent the burner 2 from becoming excessively hot during its use.

The exposed end of the head or nozzle 6 may be coplanar with that of the shell 4, or the head or nozzle 6 may be inset with respect to the shell 4.

The burner 2 is typically provided with means (not shown) for igniting the fule at start-up of the burner 2. Such means are well known in the combustion art and will accordingly not be further described herein.

In operation, a composition comprising pulverised coal suspended in water without the presence of emulsifying agents and the like is pumped through the conduit 20 to the passage 18, is atomised and passes from the passage 18 into the burner flame (not shown). Oxygen, of commercial purity, and at or neat to ambient temperature is passed under pressure into the shell 4 and flows through the passage 16 and issues therefrom typically but not necessarily at supersonic velocity and passes into the burner flame where it supports combustion of the pulverised coal. From 5%–25% by volume of the oxygen supplied to the shell 4 flows through the passage 34 into the stream of water-pulverised coal suspension flowing through the passage 18. The kinetic energy of the oxygen passing through the passage 34 is sufficient to atomise the water as mentioned above.

It is not essential in performing the methods according to the invention to employ the oxygen as the atomising medium. One alternative is to supply compressed air typically at ambient temperature to the suspension of pulverised coal in water as it is being pumped to the burner 2. Other pressurised fluids that do not condense in the water can alternatively be substituted for the air.

The suspension of pulverised coal in water may typically include 60% by weight of pulverised coal and 40% by weight of water.

As the particles of pulverised coal leave the burner 2 and enter the flame they experience the following sequence of events. First, the heat of the flame causes surrounding water to be converted to steam. Second, volatile substances are emitted from the coal as the temperature rises and these volatile substances burn in the presence of oxygen molecules supplies from the passage 16 to the flame. It is believed that supplying some of the oxygen through the passage 34 helps to bring the oxygen into intimate contact with the particles of coal and thereby facilitate the combustion of the volatile substances. Third, the carbon content of the coal burns. In conventional combustion of suspensions of pulverised coal in water using air and not oxygen or oxygen-enriched air to support combustion, the combustion proceeds from the second phase of the combustion process (combustion of volatile vapours evolving from the coal) to the third phase (combustion of carbon). However, when oxygen instead of air is used to support combustion, we hypothesise that the said second and third phases proceed more or less simultaneously rather than consecutively but do not wish to limit the scope of the invention in any way by this hypothesis.

As the partices of pulverised coal progress through the flame their temperature reaches a maximum and then falls again before they exit from the flame in the form of ash having a relatively small carbon content. Indeed, we have found it possible to produce an ash with a lower carbon content than has been achieved when using air to support the combustion of a suspension of pulverised coal in water. Moreover, we have produced a relatively short flame comparable with that formed by an oxygen-heavy fuel oil burner. These results have been obtained when burning a suspension containing only 60% by weight of pulverised coal.

Typically, substantially all the oxygen molecules that take part in the combustion of the pulverised coal are supplied from the burner 2. The oxygen or oxygen-enriched air may typically be supplied at a rate of from 90%–110% of that required for complete stiochiometric combustion of the coal.

It is preferred to use substantially pure oxygen rather than oxygen-enriched air to burn the pulverised coal as the nitrogen content of oxygen-enriched air tends to militate against complete combustion of the coal.

In order to facilitate the obtaining of a stable flame at start-up of the burner, propane may be supplied to the passage 28 via the conduit 30. This supply may, if desired, be stopped once a flame temperature typically in the order of 700° C. is achieved. This may take from say 5–500 seconds.

It is an advantage of the method according to the invention that a burner of relatively simple design, for example as illustrated in the accompanying drawings, may be used. In particular, the passage 18 can be of relatively wide diameter such that blockages caused by the particulate fuel are avoided.

The burner 2 may, if desired, fire into a cowl having a refractory inner wall or into a quorl forming part of a furnace.

It is not essential to provide the passage 28 and associated conduit 30 and connecting means 32 for propane in the burner 2. If desired, a separate supply of propane may be used to obtain a stable flame at start-up and event this provision is not essential.

Figure 3:
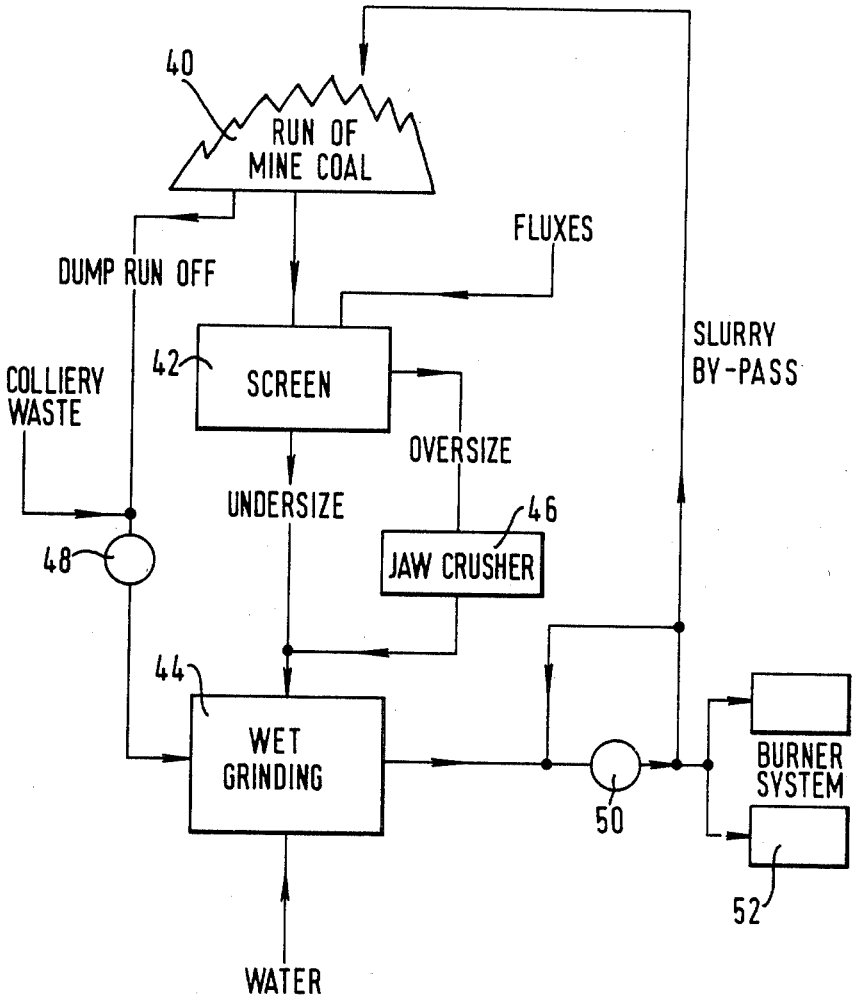
FIG. 3 is a schematic diagram illustrating plant for forming a coal-water composition for use in the present invention.

Referring now to FIG. 3 of the accompanying drawings, there is illustrated schematically a plant for making a composition comprising pulverised coal and water.

A stock 40 of run of mine coal is screened by means of a screening device 42. The particles that pass through the screen are passed directly into a wet grinder 44. Those retained on the screen are passed into a jaw crusher 46 and the resulting comminuted coal fed into the wet grinder 44. A pump 48 takes a suspension of coal dust in water from the stock 40 and pumps it to the wet grinder. If desired, colliery tailings or other colliery waste may be added to this suspension.

Sufficient water is fed into the grinder 44 to form a slurry or composition of the desired composition. The resulting slurry is pumped by a pump 50 to a burner system 52 for burning the slurry in accordance with the invention.

If desired a chosen proportion of the slurry may be recycled to the suction side of the pump 50 for the purposes of monitoring flow rate and another proportion recycled to the stock 40 for the purpose of entraining particles of coal dust.

If desired, suitable fluxes to change the chemical composition of the ash produced by burning the coal may be added to the slurry upstream or downstream of the wet grinder. Such additions are described in our U.K. patent application No. 2 099 132 A.

The method according to the invention will now be further described with reference to the following example.

EXAMPLE

A composition comprising 40% by weight of water and 60% by weight of a coarse fraction of bituminous coal particles was formed. The coarse fraction had a range of particle sizes such that 73.6% by weight passed through a sieve of sieve size 106, 57.8% passed through a sieve of sieve size 75 and 40.7% passed through a sieve of sieve size 40. The fine fraction had a range of particle sizes such that 88.7% by weight passed through a sieve of sieve size 106, 76.8% by weight passed through a sieve of sieve size 75, and 50.7% by weight passed through a sieve of sieve size 40. The coal employed was classified as bituminous 701 coal, had a calorific value of 32 540 KJ/kg, a volatile content of 35.4% by weight, an ash content of 4.6% by weight and a moisture (DAF) content of 0.8% by weight.

Figure 2:
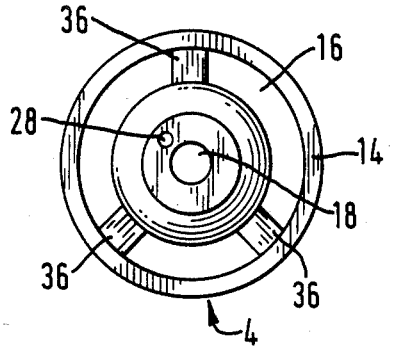
FIG. 2 is an end view of the burner shown in FIG. 1.
Figure 4:
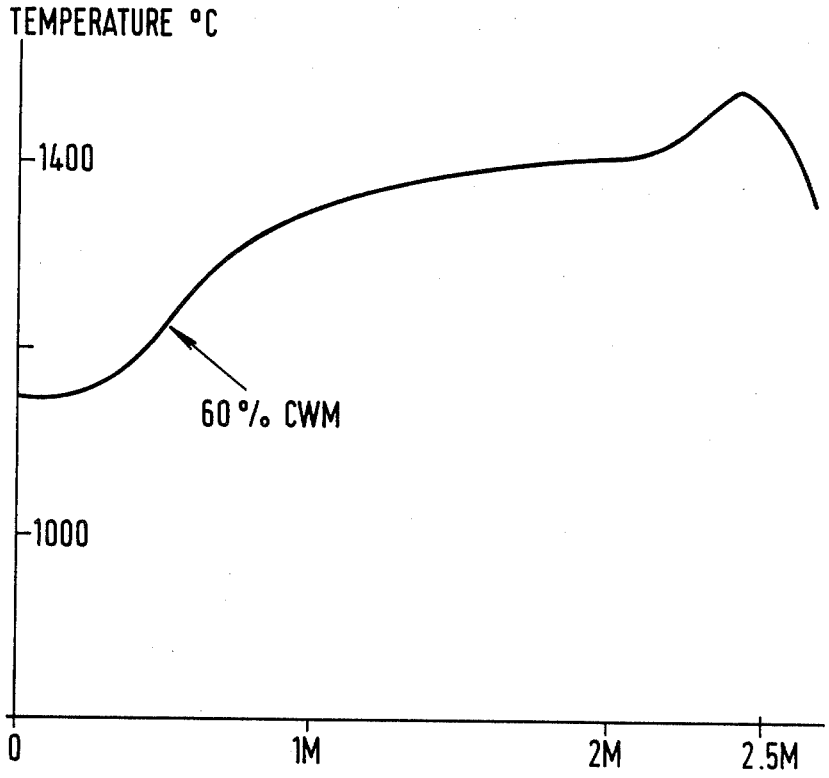
FIG. 4 is a graph illustrating the profile of a coal-water composition flame produced by the method according to the invention.

The composition was burned using a burner generally similar to that shown in FIGS. 1 and 2 save that no internal passage for forming a pilot flame such as the passage 30 was employed and that no passage equivalent to the passage 34 was used. Instead, an external propane pilot flame and air atomisation (instead of oxygen atomisation) were employed. The burner was fired into a flame tunnel 0.91 m in diameter and 3.66 m long. The burner was tilted downwards at an angle of 30° to the horizontal. A flame profile was obtained with a maximum tunnel wall temperature of 1480° C. and is shown in FIG. 4. From the shape of the profile, we deduce that flame temperatures in excess of 2000° C. can be produced with a coal-water mixture containing 60% by weight of coal of a relatively coarse grinding. It is to be appreciated that the flame produced was short, intense and highly luminous in comparison with air-oil flames and air-pulverised coal flames that are characterised by being long, lazy and less luminous.

In order to produce the profile in FIG. 4, at steady state operation, the 40% by weight water, 60% by weight coal composition was supplied to the burner at a rate of 2.0 kg per minute and temperature of 15° C. commercially pure oxygen was supplied at a rate of 2.16 cubic meters per minute, and atomising air at a rate of 0.36 cubic meters per minute. In order to obtain ignition and a stable flame a propane pilot flame was employed. Initially, the propane was supplied at a rate such that the propane supplied 30 of the total thermal energy. When the mean wall temperature had reached 530° C. after 4 minutes, the rate at which the propane was supplied was halved and when the mean wall temperature had reached 730° C. (after about 7 minutes) the supply of propane was stopped and hence the pilot flame was extinguished.

We claim:

1. A method of burning a particulate fuel which comprises atomising a composition which comprises 50 to 70% by weight of particulate fuel and 30 to 50% by weight of an aqueous carrier and which composition is able to be pumped without the presence in the composition of an emulsifying agent or lubricant to facilitate such pumping, supplying said composition to a combustion zone and supplying to the combustion zone substantially pure oxygen or oxygen-enriched air at substantially ambient temperature such that a flame temperature of at least about 2000° F. is established in said zone and combustion of the particulate fuel is supported.

2. A method accordingly to claim 1, in which the carrier is atomised upstream of the combustion zone.

3. A method according to claim 1, in which the composition is supplied to the combustion zone at ambient temperature.

4. A method according to claim 1, in which the particulate fuel is particulate coal.

5. A method as claimed in claim 4, in which the composition comprises from 55 to 65% by weight of coal, and a balance of water.

6. A method as claimed in claim 4, in which the composition comprises 60% by weight of coal, and a balance of water.

7. A method according to claim 1, in which the composition comprises relatively coarse particles of coal.

8. A method according to claim 7, in which the coal particles for the composition are formed by wet grinding.

9. A method according to claim 1, in which the composition is atomised by introducing an atomising agent into it.

10. A method according to claim 9, in which the atomising agent is a pressurised non-condensible fluid.

11. A method according to claim 9, in which the atomising agent is compressed air and is introduced into the composition upstream of a burner employed to burn the composition.

12. A method according to claim 9, in which oxygen or oxygen-enriched air is used as the atomising agent.

* * * * *

UNITED STATES PATENT AND TRADEMARK OFFICE

CERTIFICATE OF CORRECTION

PATENT NO. : 4,577,567

DATED : March 25, 1986

INVENTOR(S) : Colin Moore and David P. Jenkins

It is certified that error appears in the above-identified patent and that said Letters Patent are hereby corrected as shown below:

| | |
|---|---|
| Abstract, line 8, | "6" and "6" should be deleted. |
| Col. 1, line 26, | "it if" should read -- if it --. |
| Col. 2, line 25, | "Committe" should read -- Committee --. |
| Col. 3, line 4, | "sald" should read -- said --. |
| Col. 4, line 16, | "fule" should read -- fuel --. |
| Col. 4, line 24, | "neat" should read -- near --. |
| Col. 4, line 51, | "supplies" should read -- supplied --. |
| Col. 5, line 1, | "partices" should read -- particles --. |
| Col. 5, line 17, | "stiochiometric" should read -- stoichiometric --. |
| Col. 5, line 42, | "event" should read -- even --. |
| Col. 6, line 51, | "30" should read -- 30% --. |
| Claim 1, line 11, (Col. 7, line 1), | "2000° F." should read -- 2000° C. --. |
| Claim 2, line 1, | "accordingly" should read -- according --. |

Signed and Sealed this

Eighteenth Day of April, 1989

*Attest:*

*Attesting Officer*

DONALD J. QUIGG

*Commissioner of Patents and Trademarks*